US011426725B2

(12) United States Patent
Weber

(10) Patent No.: US 11,426,725 B2
(45) Date of Patent: Aug. 30, 2022

(54) FLOW CELL HAVING A REAGENT RESERVOIR

(71) Applicant: THINXXS MICROTECHNOLOGY AG, Zweibrücken (DE)

(72) Inventor: Lutz Weber, Merchweiler (DE)

(73) Assignee: THINXXS MICROTECHNOLOGY GMBH, Zweibrücken (DE)

( * ) Notice: Subject to any disclaimer, the term of this patent is extended or adjusted under 35 U.S.C. 154(b) by 236 days.

(21) Appl. No.: 16/314,513

(22) PCT Filed: May 24, 2017

(86) PCT No.: PCT/EP2017/062602

§ 371 (c)(1),
(2) Date: Dec. 31, 2018

(87) PCT Pub. No.: WO2018/001647

PCT Pub. Date: Jan. 4, 2018

(65) Prior Publication Data

US 2019/0262830 A1 Aug. 29, 2019

(30) Foreign Application Priority Data

Jun. 30, 2016 (EP) ..... 16177162

(51) Int. Cl.
*B01L 3/00* (2006.01)

(52) U.S. Cl.
CPC ... *B01L 3/502715* (2013.01); *B01L 3/502746* (2013.01); *B01L 2200/027* (2013.01); *B01L 2200/16* (2013.01); *B01L 2300/044* (2013.01); *B01L 2300/047* (2013.01); *B01L 2300/0867* (2013.01); *B01L 2300/0877* (2013.01); *B01L 2300/0883* (2013.01); *B01L 2300/161* (2013.01)

(58) Field of Classification Search
CPC ..... B01L 3/502715; B01L 3/502746; B01L 2300/161; B01L 2300/0883; B01L 2200/027; B01L 2200/16; B01L 2300/044; B01L 2300/047; B01L 2300/0867; B01L 2300/0877
See application file for complete search history.

(56) References Cited

U.S. PATENT DOCUMENTS 9,421,540 B2 8/2016 Delamarche et al.
2009/0075801 A1* 3/2009 Hodko ..... B01L 3/50273 494/22

(Continued)

FOREIGN PATENT DOCUMENTS

CN 103608110 A * 2/2014 ..... G01N 1/2035
EP 1203959 A1 5/2002

(Continued)

*Primary Examiner* — Matthew D Krcha
*Assistant Examiner* — Sophia Y Lyle
(74) *Attorney, Agent, or Firm* — Lucas & Mercanti, LLP; Klaus P. Stoffel

(57) ABSTRACT

A flow cell having at least one reservoir region containing a liquid reagent. The reservoir region is delimited by a carrier element introduced into an opening in the flow cell together with the reagent, wherein the carrier element seals off the reservoir region from the outside in a fluid-tight manner, and has a vessel and/or capillary structure holding the liquid reagent on the carrier element.

14 Claims, 6 Drawing Sheets

(56) References Cited

U.S. PATENT DOCUMENTS

Figure 1:
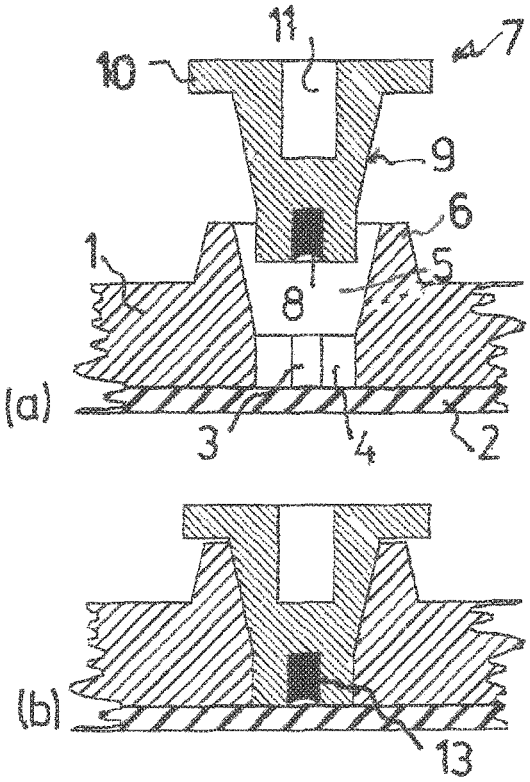

| | | | | |
|---|---|---|---|---|
| 2009/0110606 | A1* | 4/2009 | Fukushima | G01N 35/1016 422/400 |
| 2010/0084402 | A1* | 4/2010 | Chang | B01L 3/50825 220/277 |
| 2013/0299041 | A1 | 11/2013 | Beebe et al. | |
| 2013/0302842 | A1 | 11/2013 | Berthier et al. | |
| 2013/0337578 | A1* | 12/2013 | Delamarche | B01L 3/5027 436/180 |
| 2014/0033809 | A1* | 2/2014 | Bransky | B01L 3/50273 73/64.56 |
| 2016/0033375 | A1* | 2/2016 | Shih | B01L 3/502738 436/174 |
| 2016/0167047 | A1 | 6/2016 | Weber et al. | |
| 2017/0157611 | A1 | 6/2017 | Weber | |

FOREIGN PATENT DOCUMENTS

| | | | | |
|---|---|---|---|---|
| EP | 1285628 | A2 | 2/2003 | |
| EP | 2821138 | A1 * | 1/2015 | B01L 3/502707 |
| EP | 2821138 | A1 | 1/2015 | |
| EP | 2962758 | A1 | 1/2016 | |
| EP | 3108962 | A1 * | 12/2016 | B01L 3/502715 |
| WO | 2015162060 | A1 | 10/2015 | |

* cited by examiner

FLOW CELL HAVING A REAGENT RESERVOIR

The present application is a 371 of International application PCT/EP2017/062602, filed May 24, 2017, which claims priority of EP 161 77 162.1, filed Jun. 30, 2016, the priority of these applications is hereby claimed and these applications are incorporated herein by reference.

BACKGROUND OF THE INVENTION

The invention relates to a flow cell having at least one reservoir region containing a reagent.

As is known, microfluidic flow cells are increasingly employed in diagnostics, analytics and or synthesis of substances, primarily in Life Sciences. As is known, such flow cells often process very small volumes of reagents, which interact with the samples to be analyzed or processed and which have to be introduced into the flow cells in the course of production or during usage of the flow cells.

Reagents can be stored within the flow cells in storage spaces, transport channels or containers introduced into the flow cells. For the storage of liquid reagents, blisters which are closed off by predetermined breaking point barriers and which are preferably produced from aluminum laminates can in particular be considered. The holding capacity of such blisters can neither be reduced nor enlarged as desired. In particular large blisters require a cover housing which protects against accidental squeezing. In the downward direction, the holding capacity is limited by production tolerances, wherein a lower limit is around 50 microliters.

In the case of storage spaces integrated in the flow cell, although such limitations do not exist, complex connecting channels are necessary for filling and venting, which, following placement of the reagent within the flow cell, then have to be sealed by welding or bonding in order to close off the storage space in a hermetic and storage-stable manner. Liquid reagents can be, for example, fluorescent dyes, acids, alkalis, alcohols, bead solutions, lysis buffers, antibodies, enzymes, DNA fragments, PCR reagent mixtures or wash buffers.

SUMMARY OF THE INVENTION

The object of the invention is to provide a new flow cell having a reservoir region for small liquid reagent volumes, which flow cell is producible with reduced complexity in relation to the prior art.

The flow cell according to the invention which achieves this object is characterized in that the reservoir region is delimited by a carrier element introduced jointly with the reagent into an opening in the flow cell, wherein the carrier element closes off the reservoir region to the outside in a fluid-tight manner and has a vessel and/or capillary structure holding the liquid reagent on the carrier element.

Advantageously, by virtue of the present invention, both in the course of production and during usage of the flow cell, a small volume of a liquid reagent can be introduced into the flow cell, preferably reagent volumes between 1 and 100 microliters, in particular between 5 and 50 microliters. Complex venting channels which have to be sealed are able to be avoided. The reagent to be stored can be comfortably applied to the carrier element, into the vessel and/or capillary structure of the carrier element outside the flow cell, by pipetting or dipping.

In one embodiment of the invention, the reservoir region within the flow cell is hermetically closed off against inner cavities of the flow cell by at least one predetermined breaking point barrier. In this way, the flow cell provided with the liquid reagent is able to be stored on a long-term basis.

The carrier element can be connected to the flow cell solely by force closure and/or form closure, for example when the liquid reagent, during usage of the flow cell, is introduced into the flow cell. Alternatively or additionally, the flow cell is welded and/or bonded to the flow cell in a connecting region arranged at a distance from the reagent. As a result of the distance of the connecting region from the reagent, impairments of the reagent as a result of welding heat or adhesive fumes, can be avoided.

In a particularly preferred embodiment of the invention, the reservoir region is fluidically connected to at least one transport channel of the flow cell.

In particular, one transport channel of the flow cell leads toward the reservoir region and one transport channel of the flow cell away from the reservoir region, wherein in the channel or each of the channels, a predetermined breaking point barrier, which hermetically encloses the reagent, can be formed.

The opening is preferably formed in a plate-like substrate of the flow cell, and the flow cell comprises a cover, in particular a cover foil, which is connected to the substrate and which covers the opening and, where appropriate, the at least one transport channel.

The reservoir region can be delimited within the flow cell alone by the vessel and/or capillary structure of the carrier element or by the vessel and capillary structure and the cover.

Alternatively, the reagent adjoins with a free liquid surface an interior of a chamber, in particular mixing chamber, formed in the flow cell.

The carrier element is preferably configured in the form of a stopper filling the opening and comprising a front side having the vessel and/or capillary structure. In particular, the carrier element has a conical portion, which can ensure a seal-tight closure of the reservoir region given sufficient venting of the reservoir region.

Expediently, the carrier element, on an outer side facing away from the reservoir region, is provided with handling devices and comprises, in particular, a seat for connection to an assembly tool. The handling devices can be useful both in the filling of the vessel and/or capillary structure and in the fitting of the carrier element containing the reagent.

In a further embodiment, the carrier element, on an outer side facing away from the reservoir region, has a collar, which forms the above-stated connecting region and via which a welding and/or bonding to the flow cell can be realized.

In a further embodiment, the vessel and/or capillary structure has a groove which receives the reagent or a channel which receives the reagent, wherein the groove or channel is preferably at at least one end open to a peripheral surface of the carrier element.

In a particularly preferred embodiment of the invention, devices for detaching the liquid reagent from the vessel and/or capillary structure are provided.

Such devices can be designed to detach the reagent by a fluid which rinses off the reagent or by an inertia force, in particular centrifugal force, which detaches the reagent. For the generation of a centrifugal force, the flow cell can be set in rotation during use, for example by an operator device.

If the reagent, with a free liquid surface, adjoins an interior of a mixing chamber formed in the flow cell, a fluid provided in the mixing chamber can wash off the liquid reagent, in particular by shaking of the flow cell. Alternatively, in the mixing chamber the liquid reagent can be washed off by a single or multiple flushing as a sample liquid or another mixing or rinsing liquid moves back and forth.

In a particularly preferred embodiment of the invention, the groove or channel of the vessel and/or capillary structure is aligned with the transport channel leading toward the reservoir region and leading away from the reservoir region, so that a rinsing flow can flow through the reservoir region.

In a further preferred embodiment of the invention, the transport channel leading toward the reservoir region and the transport channel leading away from the reservoir region are connected by a bypass which circumvents the reservoir region. Air which is present between the liquid reagent and a rinsing flow can thus flow past the reservoir region. If the flow cross section of the bypass is smaller than that of the reservoir region, the reagent is fully washed out with the rinsing fluid.

In a further embodiment, the flow cross section of the reservoir region is smaller than the flow cross section of the transport channel leading toward and/or leading away from the reservoir region.

Furthermore, the flow cross section of the bypass can also be larger than the flow cross section of the reservoir region, so that a possibly desired delayed or gradual rinsing-out over a longer period is realized.

The carrier element can be rotatably connected to the flow cell and have, for example, a stop by which the above-stated alignment of the reservoir region with the channels is assured.

In a further embodiment of the invention, at least the vessel and/or capillary structure of the carrier element has a hydrophilic surface, by which, when wetted with the liquid reagent, a desired reagent volume is able to be more precisely measured.

For the further refinement of the measurement, the vessel and/or capillary structure of the carrier element can further be adjoined by a hydrophobic surface of the carrier element in order to achieve a sharp contrast between wettability and non-wettability.

Naturally, a carrier element could also form a plurality of reservoir regions within a flow cell.

The invention is further explained below with reference to illustrative embodiments and the attached drawings relating to these illustrative embodiments, wherein:

BRIEF, DESCRIPTION OF THE DRAWING

Figure 2:
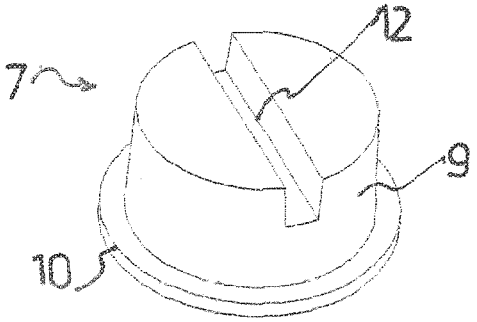
Figure 3:
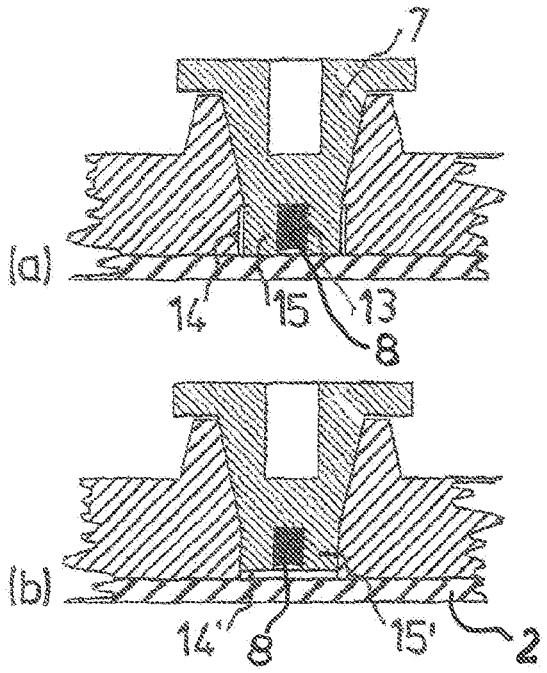
Figure 4:
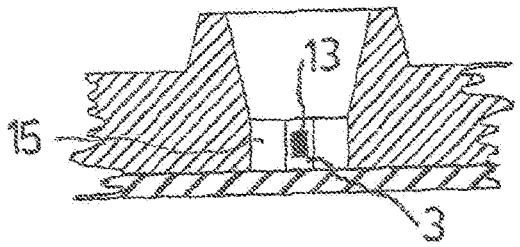
Figure 5:
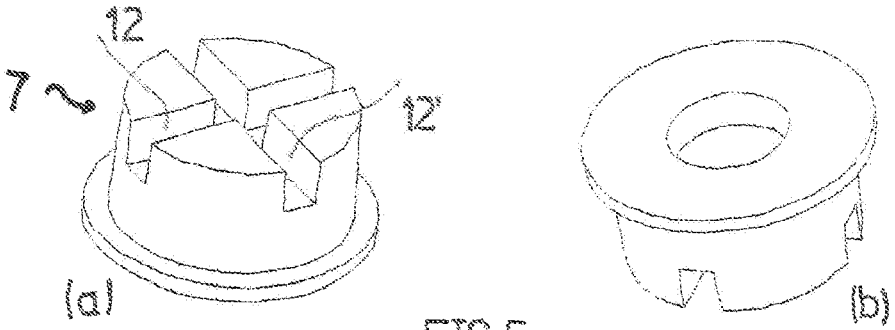
Figure 6:
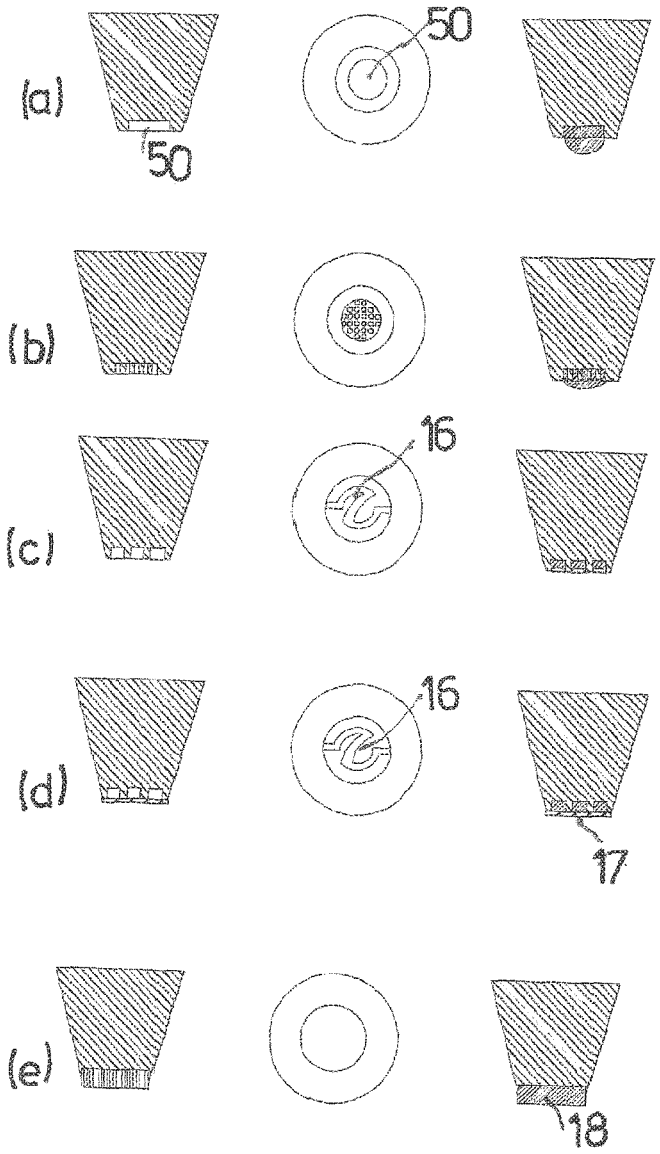
Figure 10:
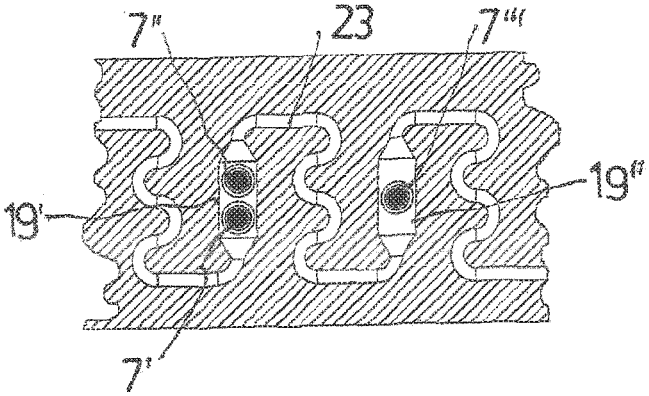
Figure 11:
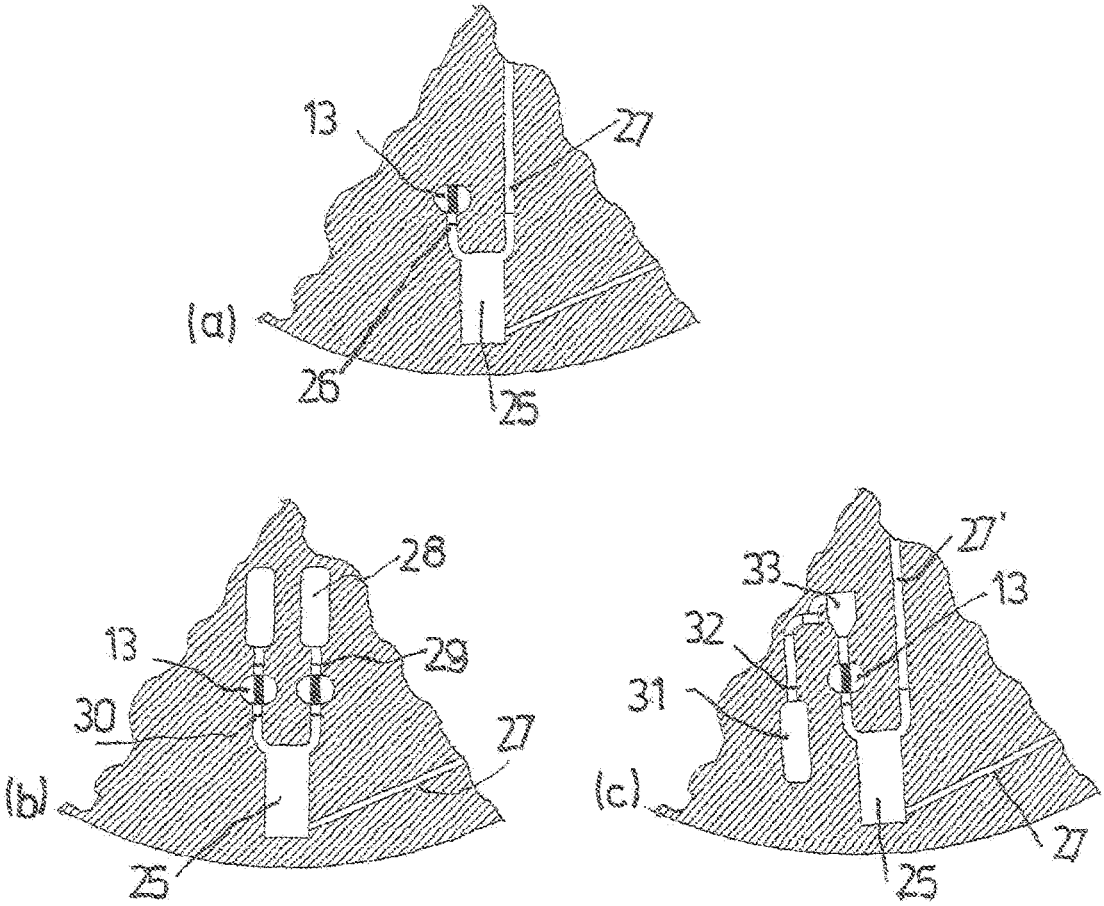
Figure 12:
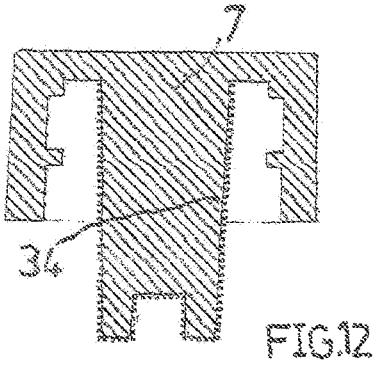
Figure 13:
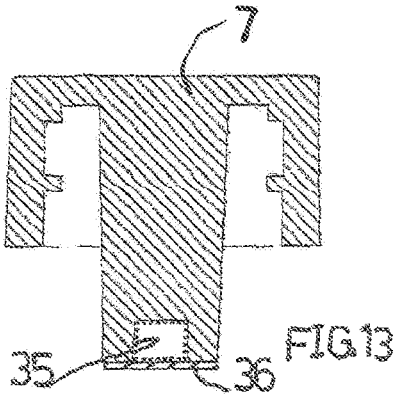
Figure 14:
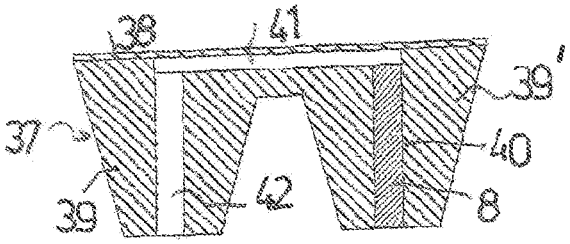
Figure 15:
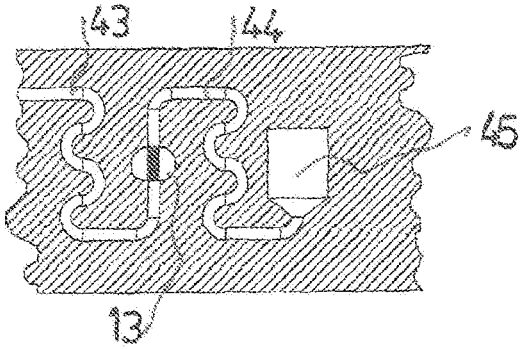
Figure 16:
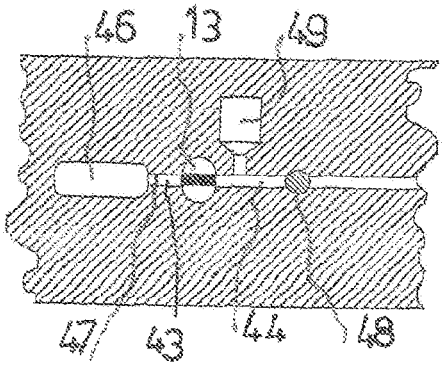

FIG. 1 shows a flow cell according to the invention comprising a reagent carrier element insertable into the flow cell, in a sectioned partial representation, FIG. 2 shows an illustrative embodiment of a carrier element usable in a flow cell according to the invention, FIGS. 3 and 4 show further embodiments of flow cells according to the invention in sectioned partial representation, FIGS. 5 and 6 show further illustrative embodiments of carrier elements according to the invention, FIGS. 7 to 11 show further illustrative embodiments of flow cells according to the invention in sectioned partial representation, FIGS. 12 to 14 show sectional views of further illustrative embodiments of carrier elements according to the invention, and FIGS. 15 and 16 shows further illustrative embodiments of flow cells according to the invention in sectioned partial representation.

DETAILED DESCRIPTION OF THE INVENTION

A flow cell represented in part in FIG. 1 expediently comprises a plate-like substrate 1, which on one plate side is bonded or welded to a foil 2. Recesses in the structure 1, which are open to the foil 2, form a structure of transport channels and chambers which is covered by the foil 2 and is typical of flow cells and of which, in FIG. 1, a transport channel 3 is visible in cross section.

The transport channel 3 opens out into a through opening 4 closed at one end by the foil 2 and having a conical portion 5. The latter is lengthened by an annular protrusion 6 connected to the substrate 1. Lying diametrically opposite the mouth of the transport channel 3 is a mouth of a further transport channel, which latter is not visible in FIG. 1.

A carrier element 7 for a liquid reagent 8 can be inserted into the through opening 4. The carrier element 7, which is rotationally symmetrical in the illustrative embodiment shown, has a peripheral surface 9 corresponding to the through opening 4 and is provided on an outer side with a circumferential collar 10. A depression 11 opening out to the outer face of the carrier element 7 serves as a seat for receiving a handling tool.

On its front side facing away from the outer face, the carrier element 7 has a vessel and/or capillary structure in the form of a groove 12 as can be seen with reference to FIG. 2, which shows a similar carrier element 7. The groove 12 is open both to the front side and to the peripheral surface 9 of the carrier element 7.

Prior to the fitting of the flow cell, the liquid reagent 8 is applied, for example by pipetting or immersion of the carrier element into a reagent supply, to the carrier element 7, where it is held in the groove 12 by capillary forces. Also following introduction of the carrier element 7 into the through opening 4 and welding and/or bonding of the collar 10 to the annular protrusion 6, the liquid reagent 8 initially remains in the groove 12 covered by the foil 2, which groove, within the now finished flow cell, forms, together with the foil 2 to which the carrier element 7 reaches, a reservoir region 13.

The storable liquid volume of such a reservoir region 13 lies between 1 and 100 microliters, preferably between 2 and 20 microliters.

The substrate 1 and the covering foil 2 preferably consist of a plastic, in particular the same plastic, for example PMMA, PC, COC, COP, PP or PE. For the preferably injection molded carrier element, in particular COC, PP, PET, PE, PMMA, PC, PEEK, TPE or silicone enter into consideration as the plastic. The carrier element 7 too can consist of the same plastics material as the substrate 1 and/or the covering foil 2. The substrate preferably consists of a more brittle plastic, such as PC or COC, the carrier element 7 of a more ductile material, such as PE or PP, in order to make the conical compression joint more pressure-stable.

During use of the flow cell, the liquid reagent 8, when necessary, is removed from the reservoir region 13, for example by a further fluid that flows in via the transport channel 3, for example a sample to be analyzed or a further stored reagent, for example a wash buffer or dilution buffer. The further fluid forces the liquid reagent 8 out of the reservoir region 13 aligned with the channel 3 into the aforementioned, diametrically opposite transport channel and can mix there with the stored reagent.

If the flushing-out and displacement of the liquid reagent 8 from the reservoir region 13 itself is realized by a liquid, then the formation of an air cushion between the liquid reagent and the latter liquid must as far as possible be avoided. A bypass 14, which, according to FIG. 3*a*, can be formed by a reduction of the diameter of a cylindrical end piece 15 of the carrier element 7, can be used for this.

As shown by FIG. 3*b*, the formation of a bypass 14' would also be possible by shortening of the end piece 15'. In the latter case, the carrier element 7 no longer extends as far as the cover foil 2. Naturally, for the venting according to FIG. 3*a*, a slot on just one side of the reservoir region 13 could also suffice.

Air streaming ahead of a flushing-out liquid flows through the bypass 14 or 14', while the liquid reagent initially continues to be held in the reservoir region 13 by capillary forces. Once the flushing liquid reaches the reservoir region, then also the bypass 14, 14' fills with flushing liquid. Since the flow cross section of the bypass 14, 14' is smaller, however, than the flow cross section in the reservoir region 13, a lower flow resistance is obtained in the reservoir region 13 and the flushing liquid transports the liquid reagent 8 out of the reservoir region.

The inflow or outflow channel is preferably aligned with the groove 12 forming the vessel and/or capillary structure, wherein the cross sections preferably have a width of 0.05 to 2 mm and a height of 0.1 to 3 mm.

At variance with the shown examples, bypasses could also be formed by virtue of the fact that the cover foil 2 is not fixedly connected to the substrate right up to the rim of the through opening 4 and is deflectable by external means, for example by underpressure, in order to form vent slots.

The flow cross section of lateral vent slots, as are shown in FIG. 3*a*, could also be larger than the corresponding cross section of the reservoir region 13, so that more flushing liquid is transported through the vent slots and the reagent is delivered over a longer period. In this way, an intensive intermixing of reagent and flushing liquid can be realized.

In a further embodiment, the reservoir region can be smaller in cross section than the cross section of the transport channels fluidically connected to the reservoir region, as is indicated in FIG. 4. Ultimately, the reagent is to some extent centered in the flushing liquid, for instance for the purpose of hydrodynamic focusing. In the illustrative embodiment of FIG. 4, the reservoir region 13 is formed solely by a passage through the cylindrical end piece 15 of the carrier element.

Further illustrative embodiments of carrier elements emerge from FIGS. 5 and 6.

FIG. 5 shows a carrier element 7 which differs from the carrier element of FIG. 2 by virtue of the fact that, for the formation of a vessel and/or capillary structure, two intersecting receiving grooves 12 and 12' are provided.

In FIG. 6, for the sake of simplicity, only ends of carrier elements having a vessel and/or capillary structure are represented. FIG. 6*a* shows a carrier element having a central, pocket-shaped depression 50, which is formed in the center of an end face of a stopper-shaped carrier element. The reagent wets the depression 50 and forms a reproducible drop shape. The depression is accessible from one side in order to flush the reagent out of the depression, the illustrative embodiment being in particular suitable for use in conjunction with a mixing chamber, as is elucidated further below.

According to FIG. 6*b*, no continuous depression, but rather a microstructured surface is formed, which latter has, for example, pillars or grooves in a modular size between 10 and 500 micrometers, preferably between 20 and 200 micrometers. Preferably, the surface is enlarged by hydrophilization and the wetting properties are improved, which produces a better control of the drop formation of the sample, and hence better reproducibility of the dimensioning of the reagent. The reagent is accessible from one side for flushing out purposes.

FIG. 6*c* shows a groove channel 16 which is open to three sides and has cross-sectional dimensions of typically $0.12\times 0.12\ mm^2$ to $2\times 2\ mm^2$. The channel region is hydrophilically modified. Smaller channel dimensions allow better control of the wettability, and hence reproducibility, of the dimension reagent quantities. The start and end of the tortuous channel can be connected to a flushing channel.

FIG. 6*d* differs from the illustrative embodiment of FIG. 6*c* by virtue of the fact that the tortuous channel 16 is covered by a plastics foil 17, which forms a component part of the, in this case, two-part carrier element. The foil 17 offers, prior to the fitting of the carrier element, protection for the reagent.

As in the illustrative embodiment of FIG. 6*c*, the faces delimiting the channel 16 can be hydrophilically modified in whole or in part. As a result of the channel 16 which fills under capillary action, reagent quantities can be precisely dimensioned, since the capillary action permits neither overfilling nor underfilling of the channel 16. The channel 16 too can be integrated for emptying into a flushing channel.

FIG. 6*e* shows a two-part reagent carrier element having a vessel and/or capillary structure, which is formed by an absorbent nonwoven fabric 18 that absorbs the reagent by capillary action. The sucked-up reagent can, within a mixing chamber for example, be extricated from the reservoir region by squeezing. A detachment by flushing-out would also be possible, for example when a particularly slow release of the reagent is desired.

Figure 7:
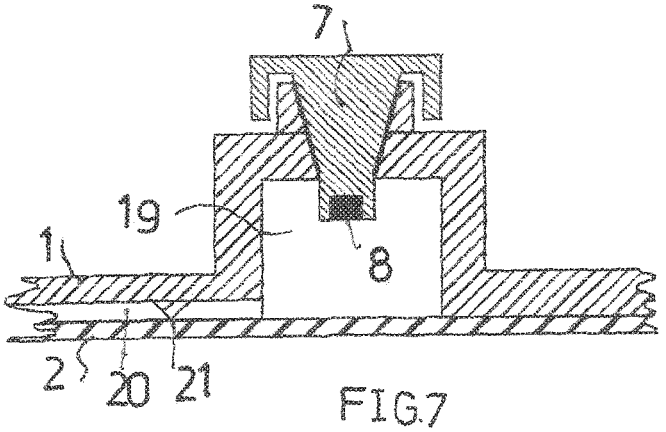

FIG. 7 shows in part a flow cell which is formed of a substrate 1 and a cover foil 2 and in which a mixing chamber 19 is provided. Projecting into the mixing chamber 19 is carrier element 7 containing a liquid reagent 8. The mixing chamber 19 is further connected to a transport channel 20, in which a predetermined breaking point barrier 21, which hermetically seals the mixing chamber 19, is formed. The predetermined breaking point barrier 21, formed by welding of a projection of the substrate 1 to the foil 2, can be opened up by pressure of the liquid in the mixing chamber 19 or by means which act on the flow cell from the outside. Liquid present in the mixing chamber 19 can wash out the reagent, which can be aided, for example, by shaking motions of the flow cell.

Figure 8:
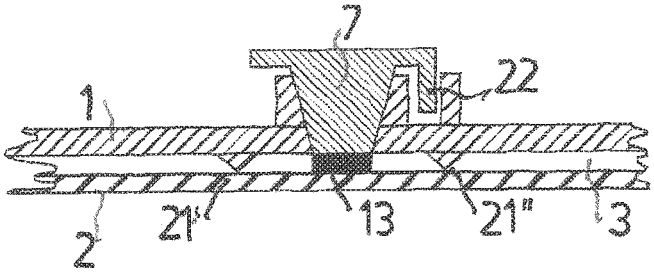

FIG. 8 shows in part a flow cell consisting of a substrate 1, a foil 2 and a reagent carrier element 7. A reservoir region 13 for a liquid reagent 8 is formed within a transport channel 3 and aligned with the transport channel. In the shown example, the reservoir region 13 is respectively hermetically closed off against the rest of the flow cell by a predetermined breaking point barrier 21' or 21", prior to use, with a view to a long-term storage of the flow cell. The storage element 7 has a stop element 22 for the precise alignment of the reservoir region 13 with the transport channel 3, for example during rotation of the carrier element 7, which in the case is rotatably connected to the flow cell.

Figure 9:
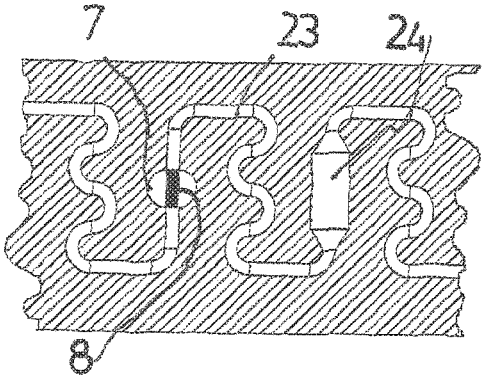

FIG. 9 shows in part a top view of a flow cell having a channel region 23 in which a reservoir region for a reagent 8 is formed by a reagent carrier element 7. In order to improve the intermixing of the reagent 8 with a transport fluid or with a sample which acts as the transport fluid and is to be studied, the channel region 23 has a meandering configuration, wherein, for the further improvement of the intermixing, a widening 24 is formed downstream. The washing-out can further be aided by transportation of the transport fluid to and fro.

A detail of a flow cell having a channel region 23 and two mixing chambers 19', 19" is shown by FIG. 10. In the mixing chambers, reservoir regions which can be washed out by reagent carrier elements 7', 7" and 7'" are formed.

FIG. 11 shows in part flow cells in the form of a round disk or disk segment. The flow cells are designed to cooperate with an operator device, which rotates the flow cells. A mixing or reaction chamber 25 is located radially further out than a reservoir region 13 formed by a carrier element.

A predetermined breaking point barrier 26 is found between the reservoir region 13 and the mixing chamber 25 of the flow cell of FIG. 11*a*. The mixing chamber 25 is further connected to a channel 27 for the feeding of a sample, for example, and/or the evacuation of the mixture from the mixing chamber, for example by pneumatic actuation. The transport of the reagent into the mixing chamber is realized by the centrifugal force generated upon the rotation of the flow cell, wherein, by the pressure of the reagent, also the predetermined breaking point barrier 26 is opened. Alternatively, the opening-up of the predetermined breaking point barrier could be realized by external means, FIG. 11*b* shows a flow cell designed for rotation, having two storage chambers 28, for example for a wash buffer or further liquid reagents. The storage chambers 28 are respectively separated from a reservoir region 13 by a predetermined breaking point barrier 29, wherein the two reservoir regions 13 are connected via further predetermined breaking point barriers 30 to the mixing chamber 25, which is connected to a feed and evacuation channel 27 respectively. By rotation of the flow cell, the wash buffer, for example, is transferred into the mixing chamber as the reservoir regions are flushed out, wherein the predetermined breaking point barriers 29, 30 can be opened up by the fluid pressure or other means.

A flow cell shown in FIG. 11*c*, which is designed for rotation, additionally has a blister reservoir 31 for a wash buffer, which blister reservoir is arranged radially further out than a reservoir region 13, thereby making full use of the installation space of the flow cell. When the blister 31 is squeezed by, for example, mechanical actuation and squeezing, a predetermined breaking point barrier 32 opens. In the squeezing of the blister reservoir 31, the buffer is transferred into an antechamber 33, which is arranged radially further in than the reservoir region 13. By rotation of the flow cell, the wash buffer present in the store room 33 is transported into the mixing chamber 25 as the reagent in the reservoir region 13 is washed out.

FIG. 12 shows a reagent carrier 7 in which not only is its vessel and/or capillary structure hydrophilized, but also the entire front side comprising the vessel and/or capillary structure, as well as a conical peripheral surface 34. The hydrophilization is formed by a vitreous layer having a contact angle to water of less than 50°.

Changes to the surface properties of the plastic forming the carrier element can be made (hydrophilically or hydrophobically), using wet chemical methods, by application of wetting agents or surfactants and subsequent drying (hydrophilic or hydrophobic). In addition, a surface activation can be performed by means of plasma, flame treatment or corona treatment (hydrophilic). Surface coatings by plasma polymerization, for example vitreous layers, hydrophilically or hydrophobically, or combinations thereof, can be applied all over/in full, or in a locally masked manner.

Instead of the hydrophilization coating applied, in FIG. 12, outside the vessel and/or capillary structure, in this region a hydrophobic coating of the carrier element could be realized, wherein the typical contact angle is greater than 100° in order to emphasize the contrast of the wettability, and hence to further refine the measuring of reagent quantities.

FIG. 13 shows a reagent carrier element 7 having a channel structure 35 which forms the reservoir region and which is formed by covering a groove, which is open on three sides, with a foil 36. The channel walls of the channel structure 35, which is open on two sides, are hydrophilized, inclusive of the foil 36, for example by wet-chemical treatment, FIG. 14 shows a two-part reagent carrier element 37 consisting of a plastics injection molding 39 and a foil 38, which reagent carrier element has two conical portions 39, 39' for sticking into two corresponding openings in a flow cell. A capillary channel 40 of one of the conical portions serves as a vessel and/or capillary structure for the reception of a liquid reagent 8. The channel 40 is connected via a channel 41 to a channel 42, which is led through the further conical portion. Via the channels 42 and 41, the channel 40 forming a reservoir region can be integrated into a flushing channel of the flow cell.

A flow cell shown in part in FIG. 15 has a reservoir region 13 for a liquid reagent, as is described above. The reservoir region 13 is connected to a feed channel 43 for a fluid for flushing the liquid reagent out of the reservoir region 13. The feed channel 43 is connected to a pressure source (not shown). An evacuation chamber 44 which leads away from the reservoir region 13 and which, like the feed channel 43, is partially tortuous, leads into a mixing chamber 45. The mixing chamber 45 is either permanently closed or has a closure valve (not shown), which can be actuated by an operator device for the flow cell.

The pressure source conveys the fluid with the rinsed-off reagent into the mixing chamber 45, in which, by compression of air contained therein, a counterpressure to the pressure source builds up. The pressure of the pressure source is variable, so that, as a result of the counterpressure built up in the mixing chamber 45, a reversal of the motion of the fluid with the rinsed-off reagent can be achieved, and the fluid with the rinsed-off reagent can be moved back and forth, with intensive intermixing, by variation of the pressure of the pressure source.

A flow cell represented in part in FIG. 16, having a reservoir region 13 for a liquid reagent, has as the pressure source a mechanically actuable blister 46, which is connected via a predetermined breaking point barrier 47 in a feed line 43 to the reservoir region 13. A valve 48, which is actuable by an operator device, is provided in an evacuation line 44. Between the reservoir region 13 and the valve 48, the evacuation line 44 is connected to a storage chamber 49.

By actuation of the blister 46, the fluid presses against the predetermined breaking point barrier 47 and opens up the predetermined breaking point barrier 47. When the valve 48 is closed, the fluid with the rinsed-off reagent is conveyed into the storage chamber 49, in which a counterpressure builds up. The counterpressure can be used for a return transport of the fluid with the rinsed-off reagent into the blister 46, wherein the wall of the blister inflates again. By repeated actuation of the blister 46, the fluid with the rinsed-off reagent is moved back and forth with intensive intermixing. Via the opened valve 49, the mixture can then be transported away for further use within the flow cell.

In the flow cells described above with reference to FIGS. 3, 4, 9 to 11 or 15 and 16, instead of carrier elements for a liquid reagent, also carrier elements for a liquid sample to be analyzed were able to be used. In particular for the flow cells according to FIGS. 15 and 16, carrier elements for a dry reagent could also be considered.

By way of supplement, it should further be mentioned that a vessel and/or capillary structure also be formed merely by hydrophilized carrier surface, in particular circular carrier surface, which, where appropriate, is adjoined by a hydrophobic surface.

The invention claimed is:

1. A flow cell, comprising: a carrier element that delimits a first reservoir region containing a liquid reagent, the carrier element being introduced jointly with the reagent into an opening in the flow cell; and a supplying transport channel and a discharging transport channel fluidically connected to the first reservoir region, wherein the carrier element bodily fills the opening so that a peripheral surface of the carrier element is in contact with an inner surface of the opening so that only the carrier element closes off the first reservoir region to the outside in a fluid-tight manner and has a vessel and/or capillary structure with a groove or channel that holds the liquid reagent on the carrier element, and wherein the groove or channel is aligned straight in a flow stream of the supplying and the discharging transport channels to permit a rinsing flow through the first reservoir region.

2. The flow cell according to claim 1, wherein the first reservoir region is hermetically closed off against a cavity within the flow cell by at least one predetermined breaking point barrier.

3. The flow cell according to claim 1, wherein the carrier element is connected to the flow cell solely by force closure and/or form closure, and/or is welded and/or bonded to the flow cell in a connecting region arranged at a distance from the reagent.

4. The flow cell according to claim 1, wherein the carrier element is configured as a stopper filling the opening and comprising a front side having the vessel and/or capillary structure, and has a conical portion.

5. The flow cell according to claim 1, wherein the carrier element, on an outer side facing away from the first reservoir region, has handling devices.

6. The flow cell according to claim 5, wherein the handling devices include a seat for a connection tool.

7. The flow cell according to claim 1, further comprising a second reservoir region that holds a fluid which rinses off the reagent, the second reservoir region being arranged upstream of the first reservoir region in a direction of flow of the fluid which rinses off the reagent.

8. The flow cell according to claim 7, further comprising, downstream of the first reservoir region in a direction of flow of the fluid which rinses off the reagent, a closed and/or closable mixing region and a pressure source that conveys the fluid with the rinsed-off reagent into the mixing region, accompanied by a build-up of a counterpressure in the mixing region.

9. The flow cell according to claim 8, wherein pressure of the pressure source, as the fluid with the rinsed-off reagent moves back and forth between the pressure source and the mixing region, is variable.

10. The flow cell according to claim 1, wherein the supplying transport channel leading toward the first reservoir region and the discharging transport channel leading away from the first reservoir region are connected by a bypass that circumvents the first reservoir region.

11. The flow cell according to claim 1, wherein the first reservoir region has a flow cross section that is smaller than a flow cross section of the transport channel leading toward and/or leading away from the first reservoir region.

12. The flow cell according to claim 10, wherein the bypass has a flow cross section that is larger than a flow cross section of the first reservoir region.

13. The flow cell according to claim 12, wherein the reagent, with a free liquid surface, adjoins an interior of a mixing chamber formed in the flow cell.

14. The flow cell according to claim 1, wherein at least the vessel and/or capillary structure of the carrier element has at least in part a hydrophilized surface region.

* * * * *